US011015355B2

(12) United States Patent
Grube

(10) Patent No.: US 11,015,355 B2
(45) Date of Patent: May 25, 2021

(54) MUD PATCH WORKING TROWEL

(71) Applicant: VIM Products, Inc., Raleigh, NC (US)

(72) Inventor: Steven Grube, Raleigh, NC (US)

(73) Assignee: VIM PRODUCTS, INC., Raleigh, NC (US)

( * ) Notice: Subject to any disclaimer, the term of this patent is extended or adjusted under 35 U.S.C. 154(b) by 0 days.

(21) Appl. No.: 16/435,727

(22) Filed: Jun. 10, 2019

(65) Prior Publication Data

US 2020/0386002 A1 Dec. 10, 2020

(51) Int. Cl.
*E04F 21/16* (2006.01)
*E04F 21/165* (2006.01)

(52) U.S. Cl.
CPC ..... *E04F 21/161* (2013.01); *E04F 21/162* (2013.01); *E04F 21/1655* (2013.01)

(58) Field of Classification Search
CPC ..... E04F 21/16; E04F 21/162; E04F 21/1655
See application file for complete search history.

(56) References Cited

U.S. PATENT DOCUMENTS 4,375,709 A 3/1983 Lewis
D296,294 S * 6/1988 Neece ..... D8/45
5,075,916 A 12/1991 Englehart
5,239,725 A 8/1993 White
D343,559 S 1/1994 Liberty
5,524,316 A * 6/1996 Johnson ..... B05C 17/10 15/210.5
D403,815 S * 1/1999 Inerbickler ..... D3/208
6,247,204 B1 * 6/2001 Hamby ..... B25G 1/10 16/431
6,513,199 B1 * 2/2003 Cheng ..... B25G 3/32 15/235.4
D561,548 S * 2/2008 Martin ..... D8/45
7,370,384 B2 * 5/2008 Miller ..... E04F 21/162 15/235.4
7,543,350 B2 6/2009 Cheney et al.
D624,720 S 9/2010 Motsenbocker
8,434,188 B1 * 5/2013 Jimenez ..... B25G 3/02 15/143.1
9,027,196 B1 5/2015 Solak
9,784,000 B1 * 10/2017 Jimenez ..... B25G 1/102
2007/0169298 A1 7/2007 Marshall, III
2013/0255016 A1 * 10/2013 Berney ..... E04F 21/162 15/105

* cited by examiner

*Primary Examiner* — Michael D Jennings
(74) *Attorney, Agent, or Firm* — Olive & Olive, P.A.

(57) ABSTRACT

A tool is shaped for working a mud patch in a shower enclosure. The tool has front and rear edges with sections angled relative to each other to allow easily contacting angled edges of the walls of the shower enclosure.

1 Claim, 9 Drawing Sheets

MUD PATCH WORKING TROWEL

FIELD OF THE INVENTION

This invention relates to a tool such as a trowel, for working a mud patch, for example, in a shower to ensure that a proper slope from walls making up the enclosure of the shower towards a generally centrally located drain.

BACKGROUND

In working a mud patch during construction of a shower, it is desirable to ensure that the mud patch slopes properly from a location at the walls of the shower toward a generally central location where a drain is located. As will be appreciated, such showers include walls at angles with respect to each other and it is necessary to ensure that the mud patch be maintained at the same level at the w all while sloping at a predetermined slope downwardly toward a centrally located drain. This is often difficult to do with conventional trowels typically made up of a rectangular main body with a handle thereon.

FIG. 10 hereof clearly illustrates the difficulty of using a conventional trowel 51 around corners 43 in a shower enclosure in which it is desired to work the mud patch 41 appropriately.

SUMMARY

This invention relates to a tool, for example, a trowel, for working a patch of mud, and particularly relates to a tool having angled edges to allow working of the mud, for example, in a shower enclosure, such that the mud is maintained at a uniform thickness at the edges of the shower and at corners making up the edges of the shower.

In accordance with the invention, a tool such as a trowel is provided for working a patch of mud in a partially enclosed area for creating a more uniform slope out of the corners of the partially enclosed area. The tool includes a body having a left side edge and a right side edge, and a front edge and a rear edge. The left side edge is longer than the right side edge. The front edge has a first front edge portion which extends perpendicular to the left side edge, and a second front edge portion angled relative to the perpendicular first front edge portion, and extending to terminate at a front end of the right edge. The rear edge has a first rear edge portion thereof which extends perpendicular to the left side edge, and a second rear edge portion angled relative to the perpendicular first rear edge portion, and extending to terminate at a rear end of the fight edge. Through this configuration, it is possible to work a stud patch and maintain a uniform thickness and slope from the edges of a shower enclosure, including corners making up the enclosure. The tool includes a top surface and a bottom surface, with a handle extending from the top surface to allow grasping of the handle for working the mud with the tool.

Other features will become apparent upon a reading of the following description.

BRIEF DESCRIPTION OF THE DRAWINGS

Having thus briefly described the invention, the same will become better understood from the following detailed discussion made with reference to the appended drawings wherein.

Each of FIGS. 9*a*, 9*b*, and 9*c* comprise a view (collectively, three views) showing how the tool of the invention can be used to work a mud patch and ensure uniform thickness at the corner of a shower enclosure while maintaining a proper slope down towards the shower drain.

DETAILED DESCRIPTION OF AN EXEMPLARY EMBODIMENT

Having generally described the invention, the same will become better understood from the following detailed description of an exemplary embodiment thereof made with reference to the appended drawings.

Figure 1:
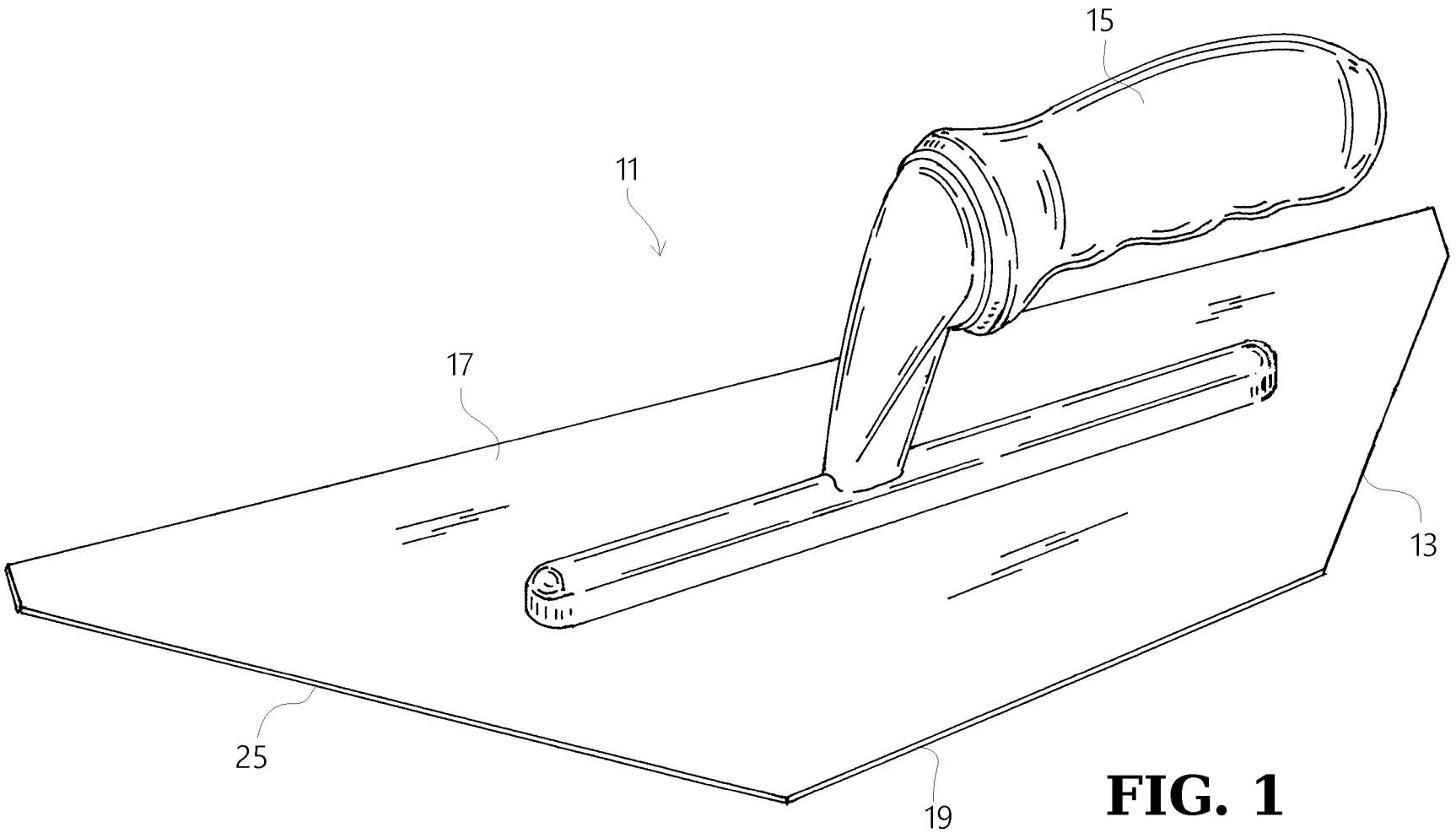
FIG. 1 is a front perspective view of the tool.

FIG. 1 is a front perspective view of the tool of the invention (typically referred to as a trowel). The tool 11 includes a main body 13 with a handle 15 attached to the main body 13.

Figure 2:
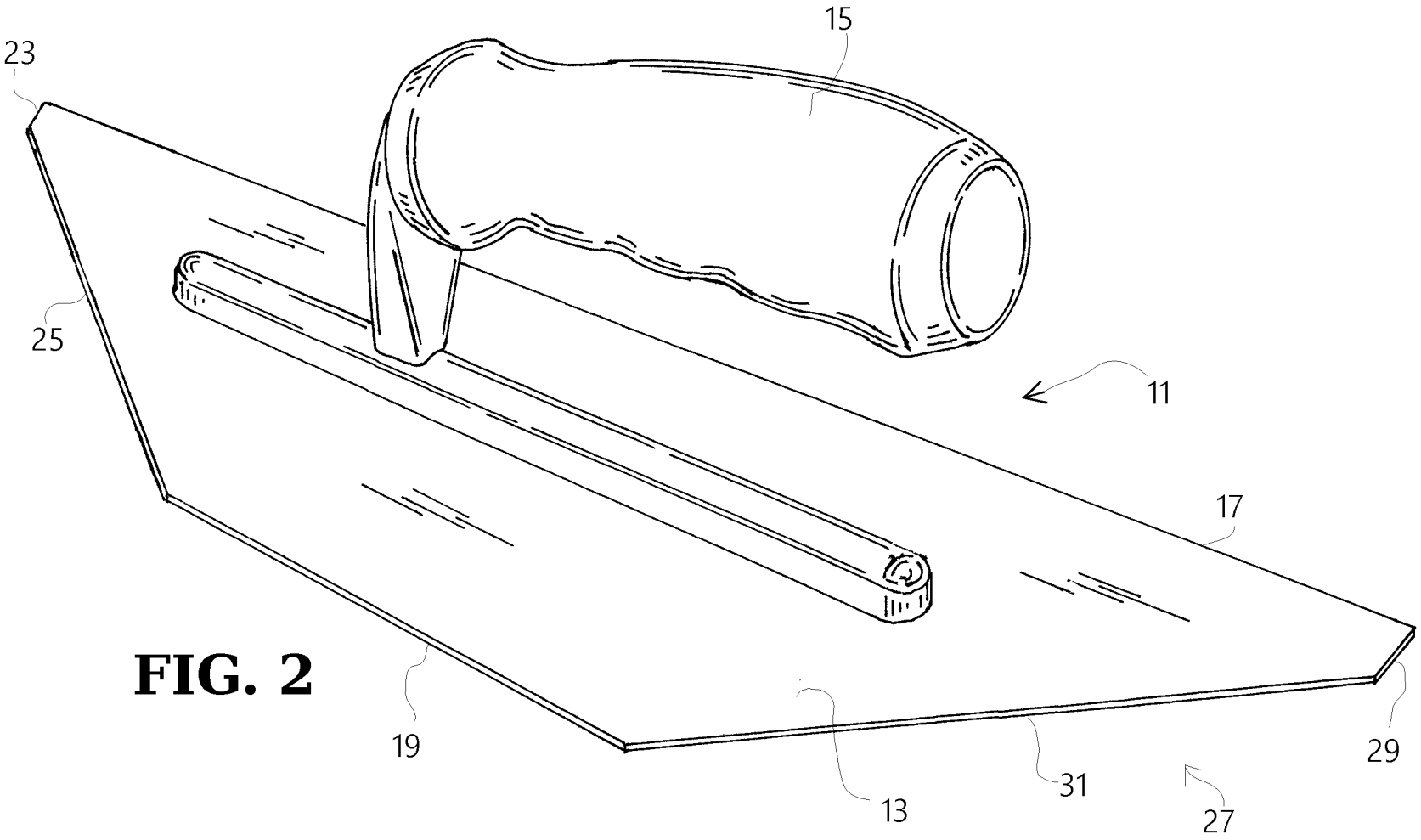
FIG. 2 is a rear perspective view of the tool.

FIG. 2 is a rear perspective view of the tool 11 of the invention also showing the main body 13 and handle 15 attached thereto.

Figure 3:
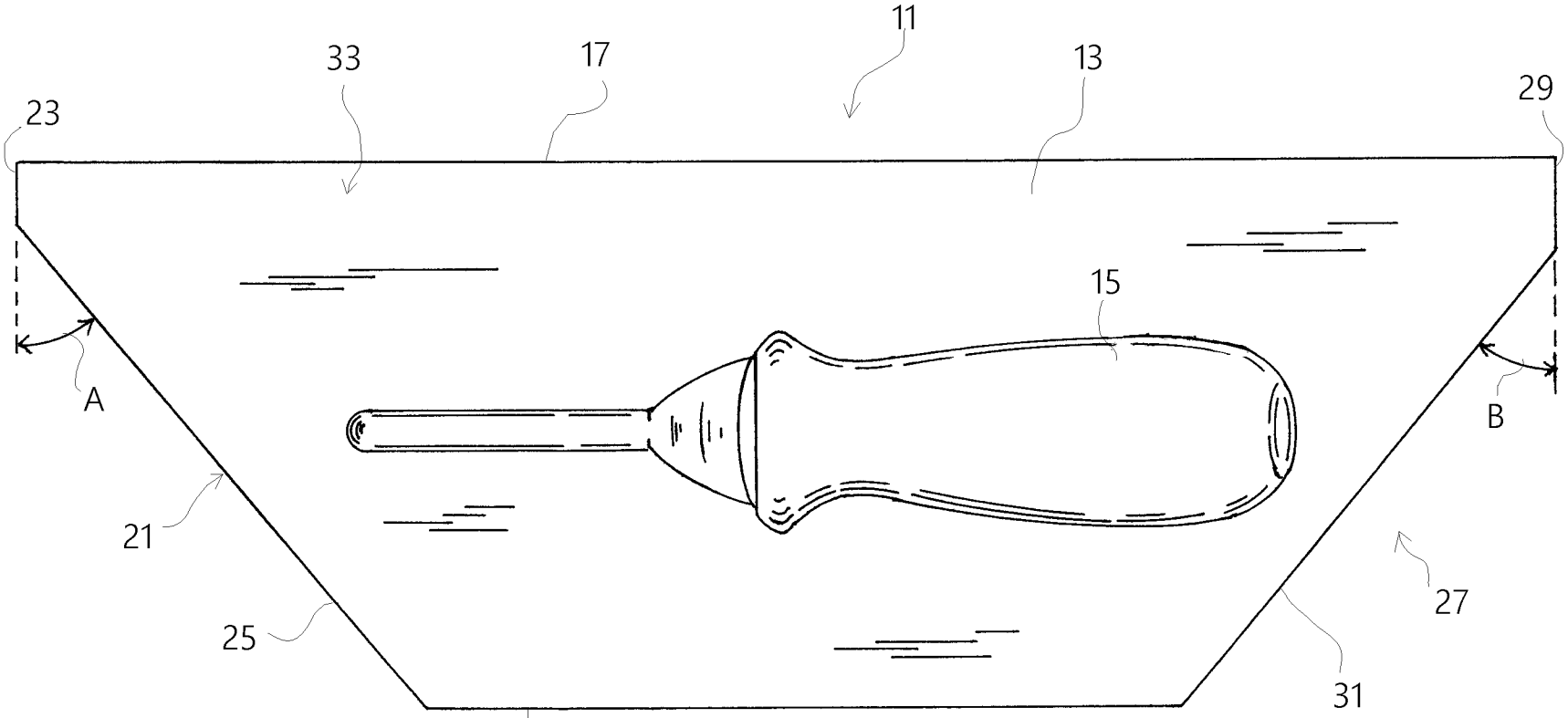
FIG. 3 is a top view of the tool.

FIG. 3 is a top view of the tool 11. The main body 13 includes a left side edge 17 and a tight side edge 19, and a front edge 25 and a rear edge 27. The front edge 25 includes two sections, i.e., a first front edge portion 23 which extends perpendicular to the left side edge 17 and a second front edge portion 25 which extends at an angle A relative to the first front perpendicular edge portion 23. The second front edge portion 25 terminates at a front end of the right side edge 19. At the rear edge 27, the left side edge 17 terminates at a first rear edge portion 29 which is perpendicular to the left side edge 17. The first rear edge portion 29 extends and is connected to a second rear edge portion 31 at an angle B. As will be appreciated, to allow flexibility when using the tool 11, the angle A is slightly greater than angle B, both being at approximately a 45 degree angle.

Figure 4:
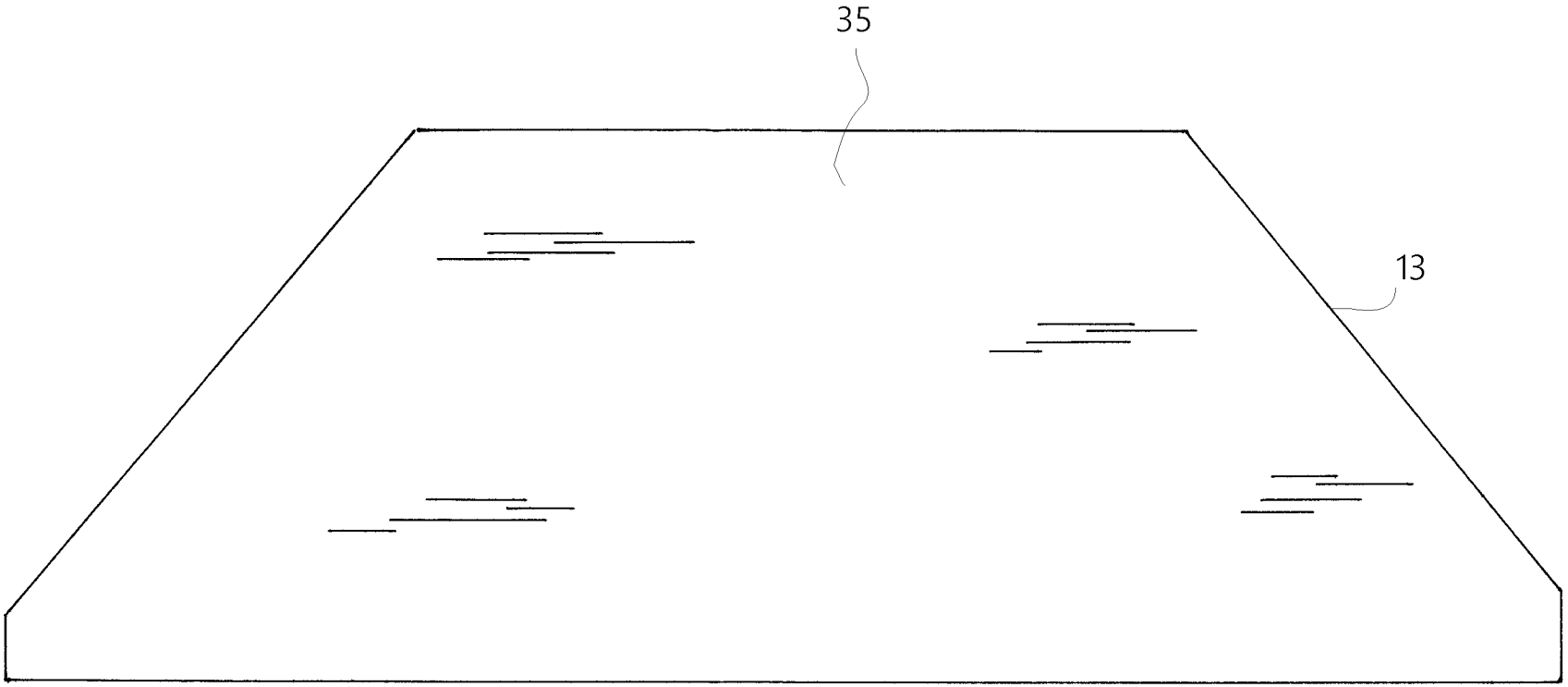
FIG. 4 is a bottom view of the tool.

FIG. 4 shows the bottom 35 of the tool 11 in accordance with the invention, more specifically, the bottom 35 of main body 13.

Figure 5:
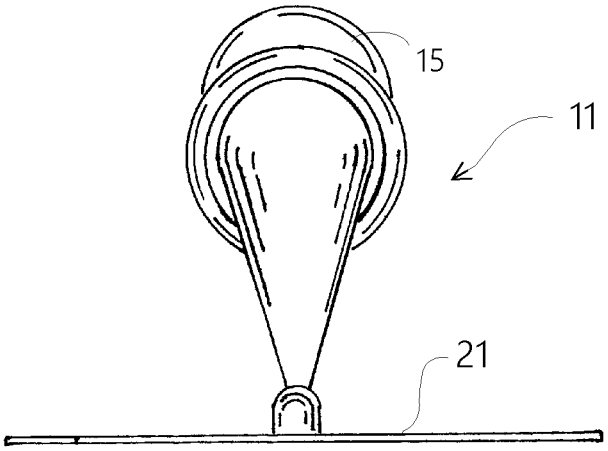
FIG. 5 is a front view of the tool.
Figure 6:
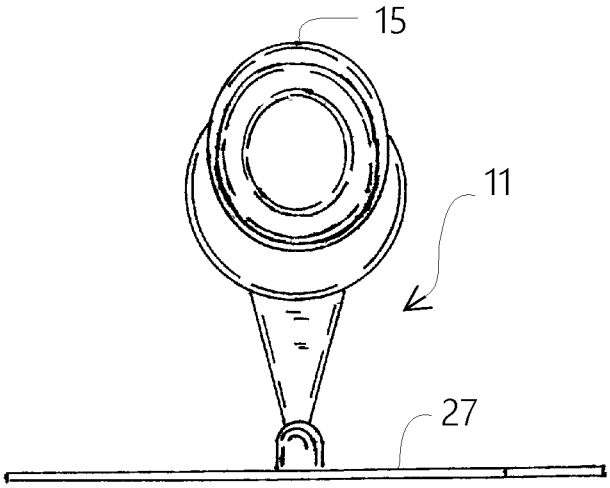
FIG. 6 is a rear view of the tool.

FIGS. 5 and 6 show front views and rear views of the tool 11 of the invention.

Figure 7:
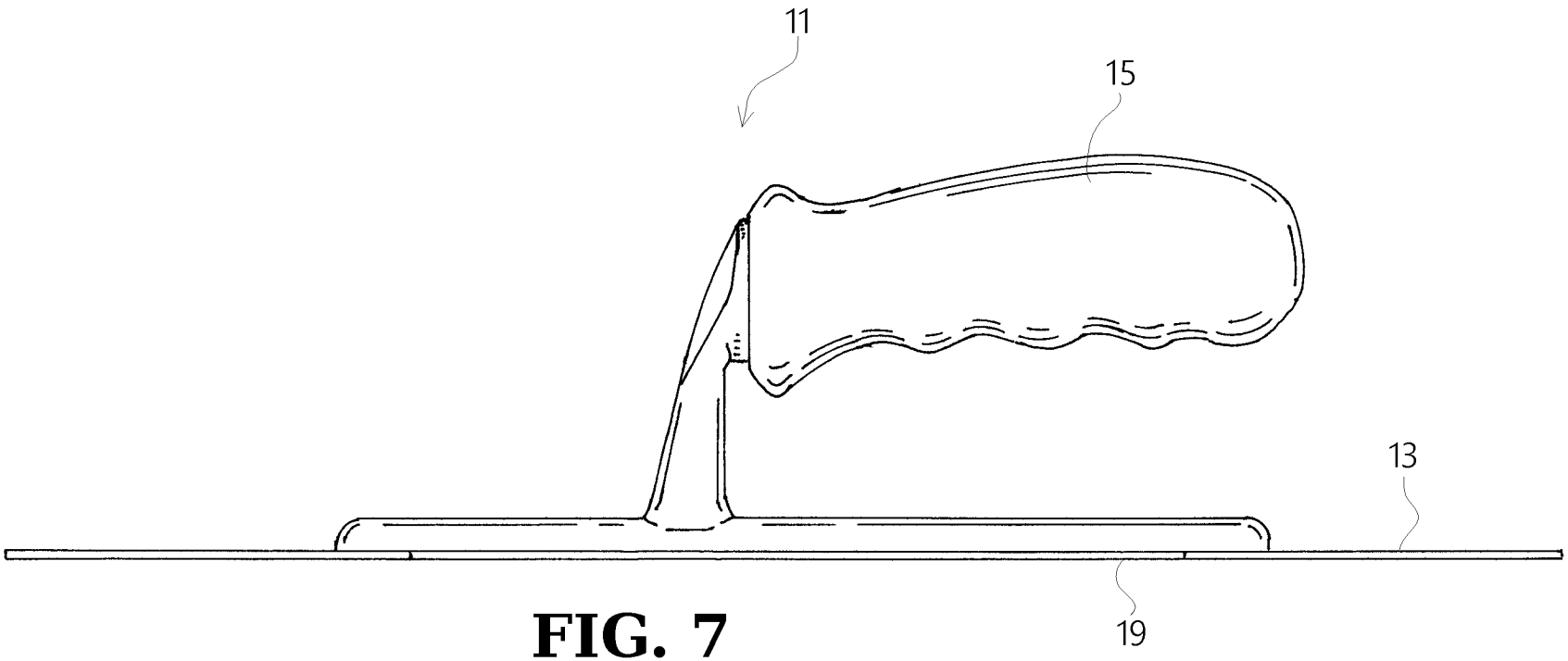
FIG. 7 is a right side view of the tool.
Figure 8:
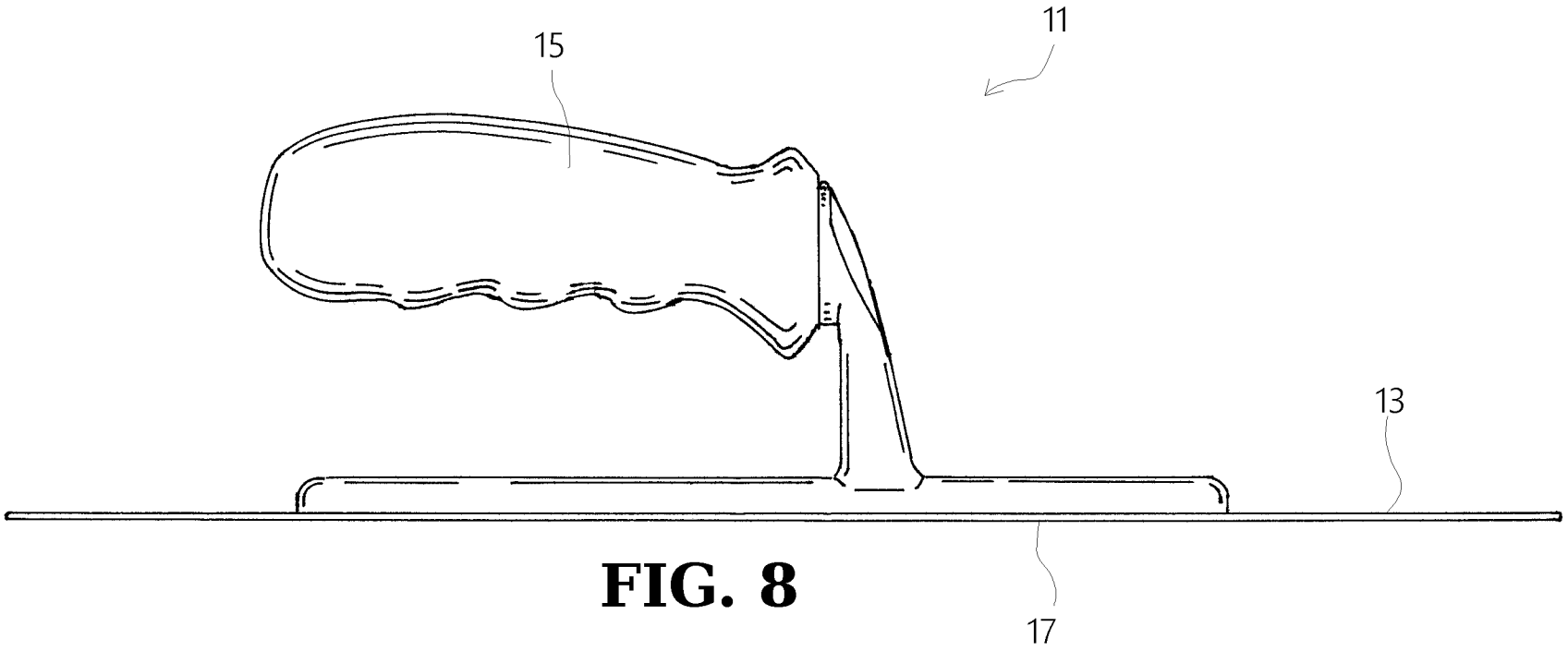
FIG. 8 is a left side view of the tool.

FIGS. 7 and 8 show right side and left side views of the tool 11 of the invention as described herein.

Figure 9A:
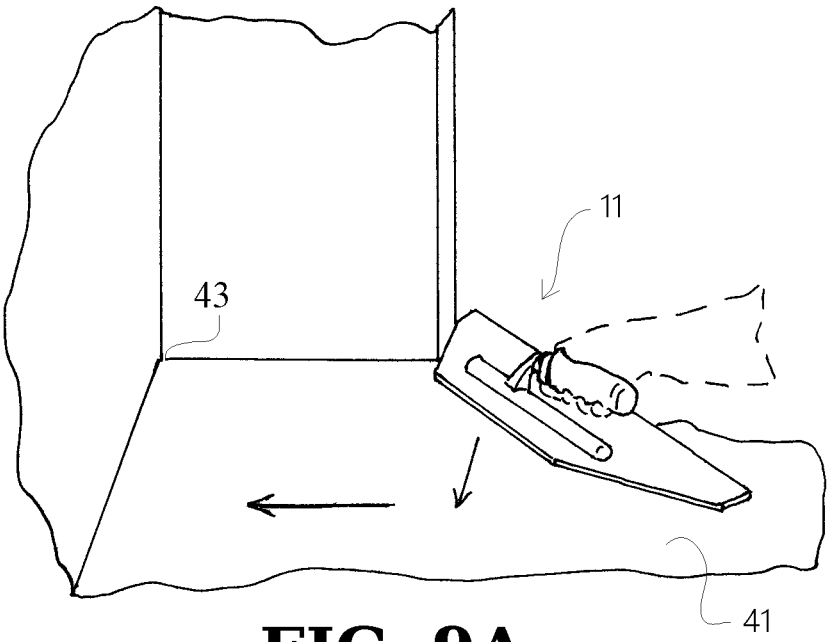
Figure 9B:
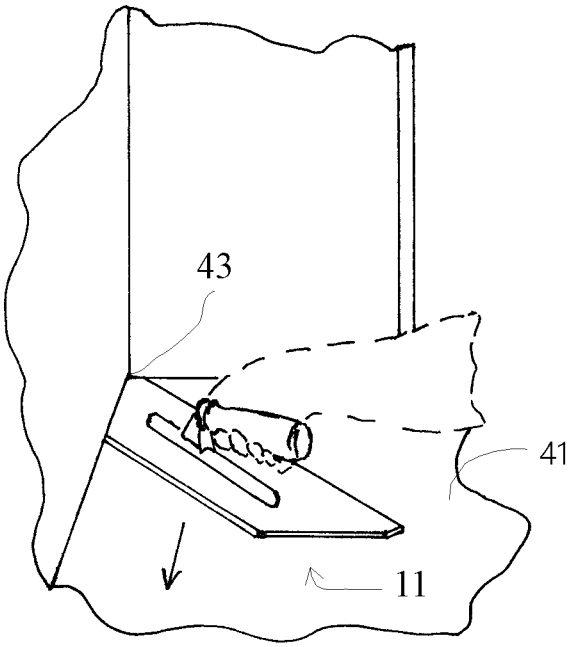
Figure 9C:
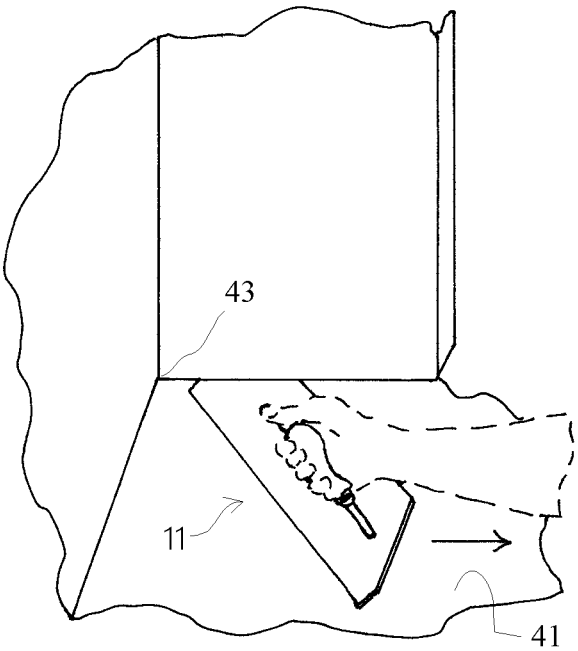

FIGS. 9*a*, 9*b*, and 9*c* each illustrate how the tool 11 of the invention can be used cork a mud patch 41 along edges 43 of walls making up a shower enclosure.

Figure 10:
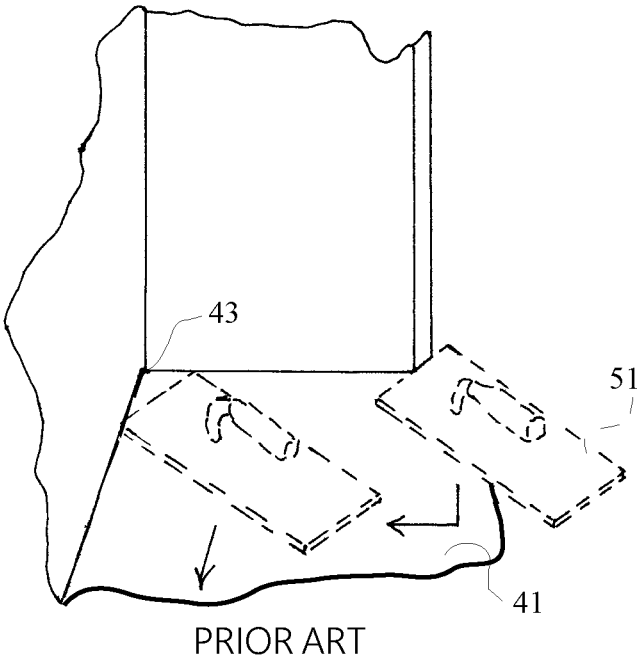
FIG. 10 is an illustration showing how a prior art trowel of conventional rectangular construction is used to work a mud patch, with difficulty when used at the corners of a shower enclosure.

FIG. 10 illustrates how a conventional trowel 51 of rectangular shape is used to work a mud patch 41 and illustrates the deficiencies and inability to work carefully along the edges 43 of the walls to ensure uniform spreading of a mud patch 41.

Having thus described the invention, it will be broadly described in the appended claims in which it is set forth in a non-limiting manner.

The invention claimed is:

1. A tool for working a patch of mud in a partially enclosed area for creating a more uniform slope extending from the corners of the partially enclosed area, comprising:

a) a body comprising a flat plate having a top surface and a bottom surface, and a handle connected to and extending upwardly from said top surface, and said flat plate having a left side edge and a right side edge, and a front edge and rear edge;

b) said left side edge being longer than said right side edge;

c) said front edge having a first front edge portion thereof extending perpendicular to said left side edge and a second front edge portion angled relative to said perpendicular front edge portion and extending to terminate at a front end of said right side edge;

d) said rear edge having a first rear edge portion thereof extending perpendicular to said left side edge, and being longer than said perpendicular front edge portion, and a second rear edge portion angled relative to said perpendicular first rear edge portion, and extending to terminate at a rear end of said right side edge; and e) the second front edge portion extends toward said front end of said right edge at an angle, relative to the perpendicular front edge portion greater than the angle at which the second rear portion extends to the right edge rear end relative to the perpendicular first rear edge portion.

* * * * *